United States Patent [19]

Ritter

[11] 4,022,535

[45] May 10, 1977

[54] ACTUATOR STRUCTURE FOR BALL-POINT PENS AND OTHER WRITING INSTRUMENTS

[76] Inventor: Wilhelm Ritter, 6101 Brensbach, Odw., Germany

[22] Filed: Apr. 30, 1976

[21] Appl. No.: 682,070

[30] Foreign Application Priority Data

Apr. 30, 1975 Germany ..... 2519212

[52] U.S. Cl. ..... 401/32; 401/111; 401/109

[51] Int. Cl.[2] ..... B43K 27/12; B43K 24/08

[58] Field of Search ..... 401/109–114, 401/29, 30, 32, 33, 65–67

[56] References Cited

UNITED STATES PATENTS 2,645,204 7/1953 Bross ..... 401/65

3,260,241 7/1966 Bross ..... 401/110 X

FOREIGN PATENTS OR APPLICATIONS 6,605,475 10/1966 Netherlands ..... 401/109

*Primary Examiner*—Lawrence Charles

*Attorney, Agent, or Firm*—Joseph A. Geiger

[57] ABSTRACT

An exterior actuator structure for the cartridge retracting mechanism of ball-point pens and other writing instruments which use either an axially movable actuator button or a longer actuator cap, the exterior actuator structure having cooperating guide portions on the shell and on the actuator member defining axially extending guide teeth and cooperating guide slots or guide grooves, for a continuous shoulder-free exterior outline of the writing instrument. Extended guide grooves accommodate a clip.

7 Claims, 10 Drawing Figures

ACTUATOR STRUCTURE FOR BALL-POINT PENS AND OTHER WRITING INSTRUMENTS

BACKGROUND OF THE INVENTION

1. Field of the Invention

The present invention relates to writing instruments, and more particularly to ball-point pens having an actuator mechanism which, under the application of pressure against a return spring, moves the writing cartridge from is writing position to its retracted position, and vice versa.

2. Description of the Prior Art

Most known ball-point pens and other writing instruments of the above-mentioned actuator type feature as part of their actuating mechanism an acutuator button which protrudes from the upper end of the pen or writing instrument, both in the writing position and in the retracted position of the cartridge, albeit to a different length in the case of certain actuating mechanisms The resulting configuration of the upper portion of the writing instrument is a protruding button surrounded by a larger shoulder. This shoulder configuration is even more pronounced in the case of multi-cartridge writing instruments, where the actuating mechanism requires a longer actuating stroke, and where the actuator pin consequently protrudes further from the main body of the pen and is therefore also more susceptible to accidental damage.

Other prior art ball-point pens and writing instruments use actuating mechanisms in which the actuator pin is replaced by an actuator cap which reaches a distance over the main shell of the pen, to near the mid-portion of the latter. Here, too, the lower end of the actuator cap forms an annular shoulder around the pen body. This shoulder is particularly undesirable, because it is located in that portion of the writing instrument which constitutes the grip zone. It has therefore become necessary, in all cases where an actuator cap is used, to fabricate the latter from metal, so as to minimize the wall thickness and the resultant height of the annular shoulder on the lower end of the actuator cap.

A still further disadvantage flowing from the annular shoulder on the lower end of the actuator cap relates to the difficulty of automatically feeding this type of writing instrument to writing machines. There, both the upwardly protruding actuator pin and the annular shoulder in the mid-portion of the writing instrument are undesirable and represent difficulties in the automatic handling of the pens.

Lastly, ball-point pens and writing instruments are subject to certain expectations by the user in regard to their aesthetic appearance, especially their overall shape and elegance of outline, which should not be dictated by the component parts of the actuator mechanism.

SUMMARY OF THE INVENTION

It is a primary objective of the present invention to eliminate the aforementioned disadvantages and shortcomings by suggesting an improved actuator structure for ball-point pens and other writing instruments.

In order to attain this objective, the invention proposes an actuator structure where the cartridge actuating member, which is either a push button on the upper end of the writing instrument or an actuator cap, engages the adjoining body shell of the ball-point pen or writing instrument with an axially oriented slot-and-tooth configuration which allows for identical outer diameters of the cooperating parts, for a continuous, cylindrical outline of the writing instrument.

In a preferred embodiment of the invention, both cooperating parts are tubular in the area of axial engagement, but one of the two parts has a smaller bore, so that this part, rather than being slotted for the accommodation of the guide teeth of the other part, has appropriate axial guide grooves receiving therein the axial guide teeth of the other part. The depth of these grooves corresponds to the wall thickness of the other part which, accordingly, is axially slotted to define alternating guide slots and guide teeth.

The outer contour of a writing instrument incorporating the novel actuator structure need not be cylindrical, but may aslo be oval or polygonal, e.g. square, hexagonal, or octagonal.

BRIEF DESCRIPTION OF THE DRAWINGS

Further special features and advantages of the invention will become apparent from the description following below, when taken together with the accompanying drawings which illustrate, by way of example, several embodiments of the invention, represented in the various figures as follows.

DESCRIPTION OF THE PREFERRED EMBODIMENTS

Figures 1, 2, 3, 4, 5, 6, 7:
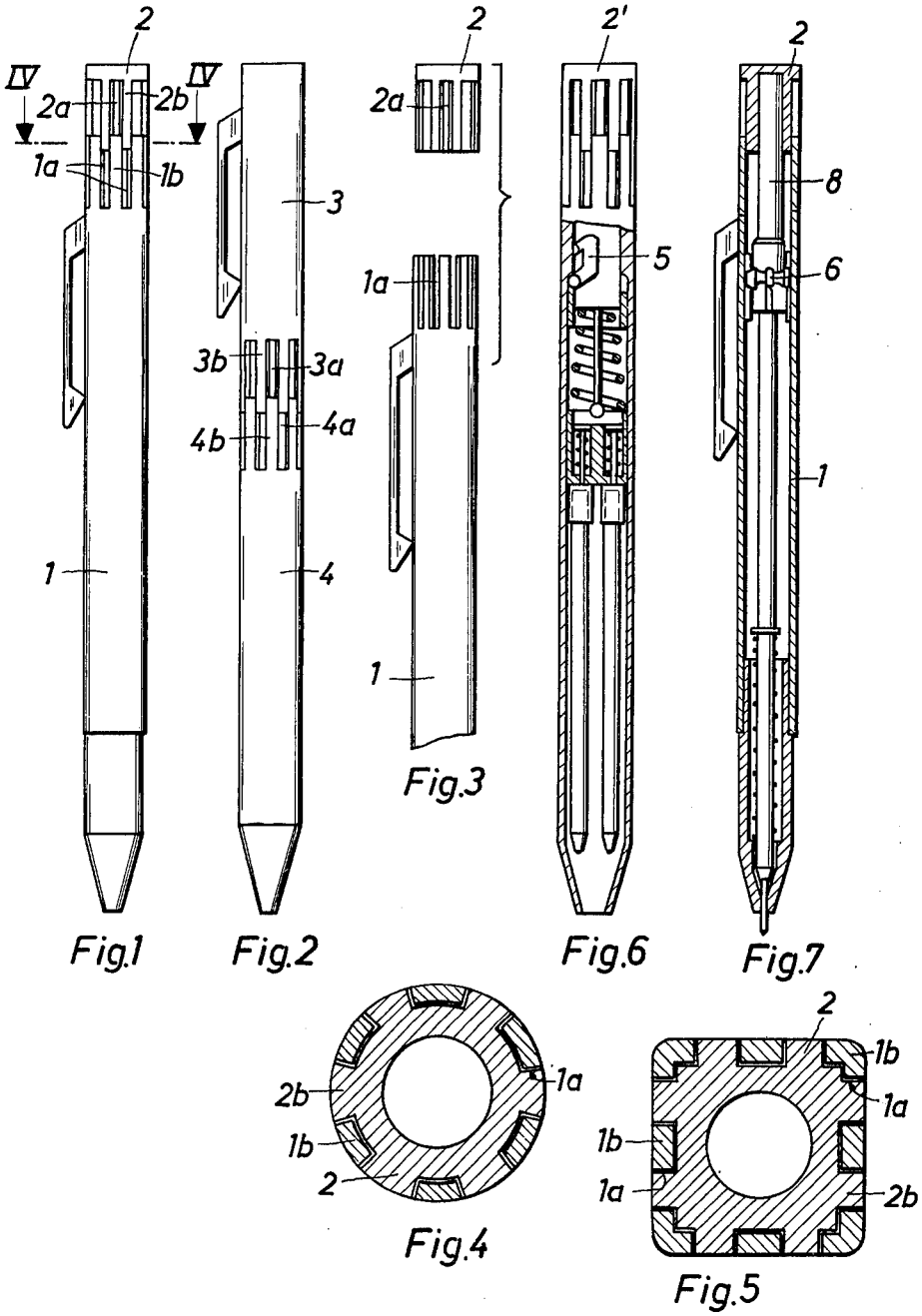
FIG. 1 shows a ball-point pen with a button-type actuator structure, representing a first embodiment of the invention.
FIG. 2 shows a ball-point pen with a cap-type actuator structure, representing a second embodiment of the invention.
FIG. 3 shows the diassembled shell and actuator button of the embodiment of FIG. 1.
FIG. 4 is an enlarged transverse cross section through the actuator structure of FIG. 1, taken along line IV—IV thereof.
FIG. 5 is a cross section, comparable to that of FIG. 4, of a writing instrument of square outline.
FIG. 6 shows a partially longitudinally cross-sectioned multi-color ball-point pen embodying the invention in its button actuator version.
FIG. 7 shows a longitudinally cross-sectioned single-color ball-point pen, likewise embodying the invention in its button actuator version, as in the embodiment of FIG. 1.

Referring to FIGS. 1, 3, and 4 of the drawing, there is shown a writing instrument, e.g. a ball-point pen, consisting of a main body surrounded by a shell 1 and carrying on its upper end an actuator button 2. As the drawing indicates, the actuator button 2 forms a continuation of the shell 1, having the same outer diameter as the latter.

The structural cooperation between the shell 1 and the actuator button 2 is shown in more detail in FIGS. 3 and 4, while FIG. 7 shows these elements assembled and longitudinally cross-sectioned. As can best be seen in FIG. 7, both the shell 1 and the actuator button 2 are generally tubular bodies, the actuator button 2 having a smaller bore and a wall portion which fits into the larger portion, the actuator button 2 includes a series of axially extending guide grooves 2*a*, defining therebetween an equal number of axial guide teeth 2*b*.

Similarly, the upper portion of the body shell 1 has arranged in it a matching series of axially extending guide slots 1*a*, defining therebetween a corresponding series of axial guide teeth 1*b* (see FIG. 3). In the assembled state, the guide teeth 1*a* of the body shell 1 engage the guide grooves 2*a* of the actuator button 2, while the guide teeth 2*a* of the latter reach into the guide slots la of the body shell 1. The resultant configuration, best shown in FIG. 4, is an assembly which has a continuous cylindrical outline, without protrusions or axial shoulders. As can best be seen in FIG. 7, this assembly configuration is not only very simple, it is also robust and sturdy. Last, but not least, the acutator configuration, by virtue of the simplicity of its lines, is also of very pleasing appearance.

In FIG. 2 is shown another embodiment of the invention, where the actuator member is of the cap-type. In this case, the upper shell portion or cap 3 of the writing instrument is vertically movable with respect to the lower body shell portion 4, the lower extremity of the cap 3 and the upper extremity of the body shell portion 4 engaging each other again with axial guide teeth 3*b* and 4*b* cooperating with matching axial guide grooves 3*a* and guide slots 4*a*, respectively. The result is again an assembly with a continuous exterior outline which, even though located in the grip portion of the writing instrument, does not affect its "feel"during use.

FIGS. 6 and 7 demonstrate that the novel actuator structure of the invention can be advantageously employed in conjunction with various internal actuatuor mechanisms. Thus, it fits the ball actuator mechanism of a multi-color ball-point pen, shown in FIG. 6, which has a heart cam mechanism, as it fits the rotating-cross-type actuator mechanism of the single-color ball-point pen which is shown in FIG. 7. While both versions utilize the button actuator version of the invention and are outwardly very similar, the interior structure of the button 2 is adapted to the specific requirements of the actuator mechanism. Thus, in FIG. 6 the actuator button 2' carries the heart cam, while in FIG. 7, the actuator button 2 forms an axial extension of the actuator pin 8, being connected to the latter, or forming an integral extension thereof.

As a comparison between FIG. 4 and FIG. 5 indicates, the actuator structure of the invention is not limited to a cylindrical outer shape, but may also be embodied in polygonal shape, for instance that of a square. Of course, various other shapes, such as hexagonal, octagonal, or oval, may likewise be used.

Figure 8:
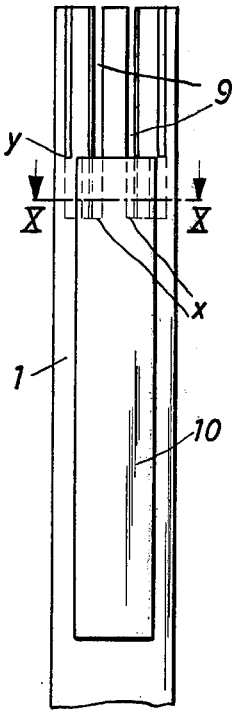
FIG. 8 shows an enlarged upper portion of the body shell of a writing instrument similar to that of FIGS. 1 and 3, illustrating the attachment of a clip.
Figure 9:
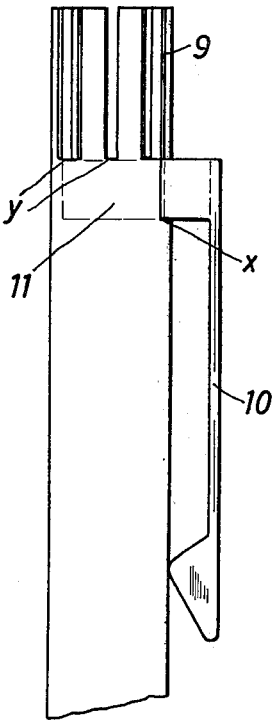
FIG. 9 is a lateral view of the assembly of FIG. 8.
Figure 10:
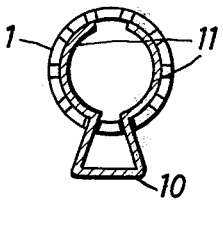
FIG. 10 is a transverse cross taken along line X—X of FIG. 8.

Referring to FIGS. 8-10, there is shown a very simple way of attaching a clip to a writing instrument embodying the present invention. For this purpose, it suffices to axially extend two slots 9 deeper into the body shell 1, to point *x*, while the other slots terminate at point y. The clip 10 has two arcuate leg portions 11, reaching through the extensions of the slots 9 to the inside of the body shell 1. These leg portions 11 have an axial width which is equal to the distance between the points *x* and *y*. They are preferably outwardly spring-biased against the wall of the body shell 1.

The number of cooperating axial guide teeth and axial guide slots or guide grooves, respectively, may be different from case to case, depending on the diameter of the writing instrument, on the stroke to be executed by the actuator member, and on the materials used for the cooperating body shell and actuator button, or body shell and actuator cap, respectively. It is important that the actuator structure provide proper axial guidance for the actuator button or actuator cap.

It should be understood, of course, that the foregoing disclosure describes only preferred embodiments of the invention and that it is intended to cover all changes and modifications of these examples of the invention which fall within the scope of the appended claims.

I claim the following:

1. In a ball-point pen or other writing instrument having an actuator mechanism by means of which a writing cartridge, movably arranged inside a body shell of said writing instrument, can be shifted longitudinally upwardly from a writing position to a retracted position, and vice versa, in said writing instrument, an exterior actuator structure comprising in combination:

an actuator member arranged longitudinally above the body shell of the writing instrument and engaging the upper extremity of the latter so as to be guided for axial movement relative thereto; and cooperating guide portions of substantially equal outer contour on the lower extremity of the actuator member and on the upper extremity of the main shell; and wherein a first one of the two guide portions is tubular in cross section and has in its wall a series of axially extending parallel guide slots, which are angularly spaced on its circumference and open towards the other guide portion, thereby defining between them a first set of axially extending guide teeth; and the second one of the two guide portions has a series of axially extending parallel recesses matching said first guide teeth for cooperation therewith in turn, defining between them a second set of axially extending guide teeth fitting into the guide slots of the first guide portion.

2. An actuator structure as defined in claim 1, wherein said second guide portion has a heavier wall than the first guide portion, its axial recesses being guide grooves of a radial depth that corresponds substantially to the wall thickness of the first guide portion.

3. An actuator as defined in claim 2, wherein the actuator member is an actuator cap forming an upper length portion of the writing instrument;

the first guide portion is part of the main shell of the writing instrument; and the second guide portion is part of the actuator cap.

4. An actuator structure is defined in claim 2, wherein the actuator member is an actuator button forming the upper end of the writing instrument;

the first guide portion is a part of the main shell of the writing instrument; and the second guide portion is part of the actuator button.

5. An actuator structure as defined in claim 4, wherein two of the guide slots in the guide portion of the body shell have axial extensions reaching a distance below the maximum axial slot depth necessary for the movement of the guide teeth of the actuator button, for the attachment to that part of the body shell of a clip having two leg portions reaching through said slot extensions to the inside of the body shell wall.

6. An actuator structure as defined in claim 1, wherein the engaged guide portions of the actuator member and body shell form an assembly having a continuous cylindrical outline in all positions of the actuator member.

7. An actuator structure as defined in claim 1, wherein the engaged guide portions of the actuator member and body shell form an assembly having a continuous polygonal outline in all positions of the actuator member.

* * * * *